US006021618A

United States Patent [19]

Elderson

[11] Patent Number: 6,021,618

[45] **Date of Patent: *Feb. 8, 2000**

[54] STUD WALL SYSTEM AND METHOD USING SPACER MEMBER

[76] Inventor: William L. Elderson, 1164 Lloyd Rd., Wickliffe, Ohio 44092

[ * ] Notice: This patent is subject to a terminal disclaimer.

[21] Appl. No.: 09/016,663

[22] Filed: Jan. 30, 1998

Related U.S. Application Data

[63] Continuation of application No. 08/337,625, Nov. 10, 1994, Pat. No. 5,784,850.

[51] Int. Cl.[7] ..... E04B 2/60

[52] U.S. Cl. ..... 52/667; 52/481.1; 52/669; 52/720.1; 52/731.9; 52/739.1; 403/375; 428/603

[58] Field of Search ..... 52/664, 243, 356, 52/354, 762, 481.1, 653.1, 656.1, 731.9, 210, 241, 483.1, 667, 668, 669, 720.1, 739.1, 745.09; 403/353, 375, 384; 428/582, 597, 598, 603

[56] References Cited

U.S. PATENT DOCUMENTS

| | | | |
|---|---|---|---|
| 992,941 | 5/1911 | Danielson . | |
| 1,101,745 | 6/1914 | Jones . | |
| 2,430,654 | 11/1947 | Voege . | |
| 3,305,981 | 2/1967 | Biggs et al. . | |
| 3,374,591 | 3/1968 | Tillish et al. | 52/667 |
| 3,482,369 | 12/1969 | Burke . | |
| 3,562,970 | 2/1971 | Schwartz | 52/239 |
| 4,018,020 | 4/1977 | Sauer et al. | 52/241 |
| 4,235,054 | 11/1980 | Cable et al. . | |
| 4,426,822 | 1/1984 | Gailey . | |
| 4,448,004 | 5/1984 | Thorsell | 52/241 |
| 4,791,766 | 12/1988 | Egri, II . | |
| 4,850,169 | 7/1989 | Burkstrand et al. . | |
| 4,858,407 | 8/1989 | Smolik . | |
| 4,914,878 | 4/1990 | Tamaki et al. | 52/239 |
| 5,127,760 | 7/1992 | Brady . | |
| 5,155,962 | 10/1992 | Burkstrand et al. | 52/667 |
| 5,274,973 | 1/1994 | Liang | 52/243 |
| 5,720,138 | 2/1998 | Johnson | 52/241 |

OTHER PUBLICATIONS

"Products That Meet The New A.D.A. Code Flush Mount And Notch Tite and Other Products: Fire Blocking, Bridging, SLP–TRK And Specialty Items"; Metal Lite, Inc., Anaheim, CA, 1991.

Metal Stud Manufacturer's Association, Feb. 1995.

*Primary Examiner*—Carl D. Friedman
*Assistant Examiner*—Kevin D. Wilkens
*Attorney, Agent, or Firm*—Renner, Otto, Boisselle & Sklar, P.L.L.

[57] ABSTRACT

A metal stud wall and method of assembling the same are characterized by stud spacer member comprising an elongate bar-like member and at least three equal spaced notches disposed along the elongate member for receiving and engaging therein a web of a metal stud. In the assembly of a metal stud wall comprising a row of metal studs each having at least two flanges interconnected by a web, the stud spacer member is inserted through aligned openings in the webs of three or more studs and the webs are engaged in the notches to position and hold the metal studs at a prescribed spacing. Successive spacer members may be inserted through further studs and overlapped with the preceding spacer member to position and hold the studs at the prescribed spacing.

19 Claims, 1 Drawing Sheet

10
12
14
16
18
20
22
24
26
26'
26a
26b
26c
26d
26e
30
32
36
38
40
42
44
46
48
50

STUD WALL SYSTEM AND METHOD USING SPACER MEMBER

RELATED APPLICATIONS

This is a continuation of U.S. patent application Ser. No. 08/337,625, filed Nov. 10, 1994, now U.S. Pat. No. 5,784,850.

FIELD OF THE INVENTION

The invention herein described relates generally to stud wall systems and more particularly to a device for properly spacing studs during construction of a stud wall.

BACKGROUND OF THE INVENTION

Metal studs are commonly used today to form non-load bearing walls in building structures. In a typical installation, the metal studs are secured by screws at their lower ends to a bottom track secured to a floor and at their upper ends to a top track secured to overhead joists which may form the framework for an upper floor. Wall boards or other panels are applied to the sides of the studs to form a closed wall structure. A problem with this arrangement is that deflection of the overhead joists under loads is translated into vertical loads acting on the studs. These vertical loads may cause bowing or other flexing of the metal studs which may cause the walls to crack or otherwise be flawed or damaged.

Deflection track wall systems heretofore have been used to combat the problem of wall bowing and/or cracking arising from overhead loads being applied to the vertical studs in a non-load bearing wall. Three known deflection track wall systems are the crimped track system, the double track system, and the track and brace system.

In the crimped stud system, the top track has a horizontal crimp in each flange thereof. This permits relative vertical movement between the upper and lower portions of each flange of the top track. Accordingly, the metal studs can be fastened to the lower portions of the flanges of the top track while the crimps in the flanges accommodate vertical deflections of the overhead structure to which the web of the top track is secured.

In the double track system, two top tracks are nested one within the other. The larger or upper track is attached to the overhead joists or other overhead structure. The smaller or lower track is nested within the larger track and has attached thereto the upper ends of the metal studs. There is a gap between the webs of the two tracks that permits vertical movement of the larger track without corresponding movement of the smaller track.

The track and brace system uses a horizontal brace which spans two or more metal studs. The brace extends through a conduit hole in the web of each metal stud and is fastened to an L-shape clip that in turn is fastened to the stud. The brace eliminates the need to fasten the upper ends of the metal studs to the top track which is then free to move vertically without imparting vertical loads in the metal studs.

The installation of metal stud wall systems, including deflection track wall systems, heretofore has been a time consuming process. In a typical installation where the metal studs are fastened at their upper ends to a top track or channel, the attachment positions of the studs are marked off along the top track. Then each stud is fastened to each flange of the top track by screws. Often a ladder must be used because the top track is too high for the installer to reach. The installer climbs the ladder and fastens as many studs as he can reach to the near flange of the top track. Then he must climb down the ladder, move the ladder along the wall so that when he again climbs the ladder he can reach the next one or more studs for fastening to the top track. After doing this along one side of the wall, the process is repeated on the other side of the wall to fasten the studs to the other flange of the top track. A similar process is used to install a track and brace wall system, except that the fastening positions of the metal studs are usually marked off along the brace. Also, only one pass is needed to fasten the stud clips to the brace. Although less time consuming in these respects, the time savings is more than offset by the time expenditure or cost associated with fastening the stud clips to the metal studs.

SUMMARY OF THE INVENTION

The present invention provides a device, i.e., a stud spacer member, that enables a substantial reduction in the amount of time needed to install the stud wall and, in particular, a deflection track wall. The invention also provides a metal stud wall including the device and a method of assembling a metal stud wall using the stud spacer member.

The stud spacer member comprises an elongate bar-like member and at least three equal spaced notches disposed along the elongate member for receiving and engaging therein a web of a metal stud. In assembling a metal stud wall comprising a row of metal studs each having at least two flanges interconnected by a web, the stud spacer member is inserted through aligned openings in the webs of three or more studs and the webs are engaged in the notches to position and hold the metal studs at a prescribed spacing. Successive spacer members may be inserted through further studs and overlapped with the preceding spacer member to position and hold the studs at the prescribed spacing.

In a preferred embodiment, the elongate member has a longitudinally extending planar first portion and one or more second portions longitudinally coextensive with the first portion and deflected out of the plane of the first portion for rigidifying the elongate member against flexure about an axis perpendicular to the longitudinal axis of the elongate member. More particularly, the elongate member may be V-shape in cross-section along the length thereof with the side portions thereof respectively forming the first and second portions.

The elongate member preferably includes at least one other notch equal spaced between at least two of the three notches, with the notches being disposed along and open to a longitudinal edge of the first portion for receiving and engaging a web of a metal stud. Three of the notches may be spaced on 16 inch centers whereas the fourth notch and the two outermost of the three notches may be spaced on 24 inch centers, whereby a single stud spacer member may be used for both conventional wall stud spacings.

Further in accordance with a preferred embodiment, the notches may be defined by an opening formed when a portion of the elongate member is bent out of the plane of the elongate member. In an alternative arrangement, the notches may include an outer slot portion and a relatively wider inner portion, the outer slot portion extending from the wider inner portion to an edge of the elongate member.

According to another aspect of the invention, a stud spacer member is characterized by an elongate member having a plurality of longitudinally spaced apart notches for receiving and engaging therein a web of a metal stud, and a resilient device adjacent one side of each the notch for resiliently biasing the web of the stud towards and against an opposing side of the notch. Preferably, the notches are formed in relatively planar portions of the elongate member and the resilient device is formed by resilient flap bent out of the planar portion. The opposing side of the notch preferably is an edge in the plane of the planar portion formed when the flap portion of the elongate member is cut and bent out of the plane of the member portion.

According to another aspect of the invention, a method for spacing a plurality of metal studs in a stud wall comprises the steps of inserting a stud spacer member through aligned openings in at least three metal studs and engaging longitudinally spaced apart notches in the stud spacer member with the webs of the three metal studs, respectively, thereby establishing and maintaining a fixed center-to-center spacing between the metal studs. As is preferred, the bottom ends of the studs are secured to a base member at such center-to-center spacing while the stud spacer member spaces the upper ends of the metal studs. At least one of the metal studs in a row thereof spaced by one or more stud spacer members is fixed to surrounding structure and held in vertical orientation, whereby the remaining metal studs in such row will be held in vertical orientation.

The foregoing and other features of the invention are hereinafter fully described and particularly pointed out in the claims, the following description and the annexed drawings setting forth in detail certain illustrative embodiments of the invention, these being indicative, however of but a few of the various ways in which the principles of the invention may be employed.

DETAILED DESCRIPTION

Figures 1, 2, 3, 4, 5:
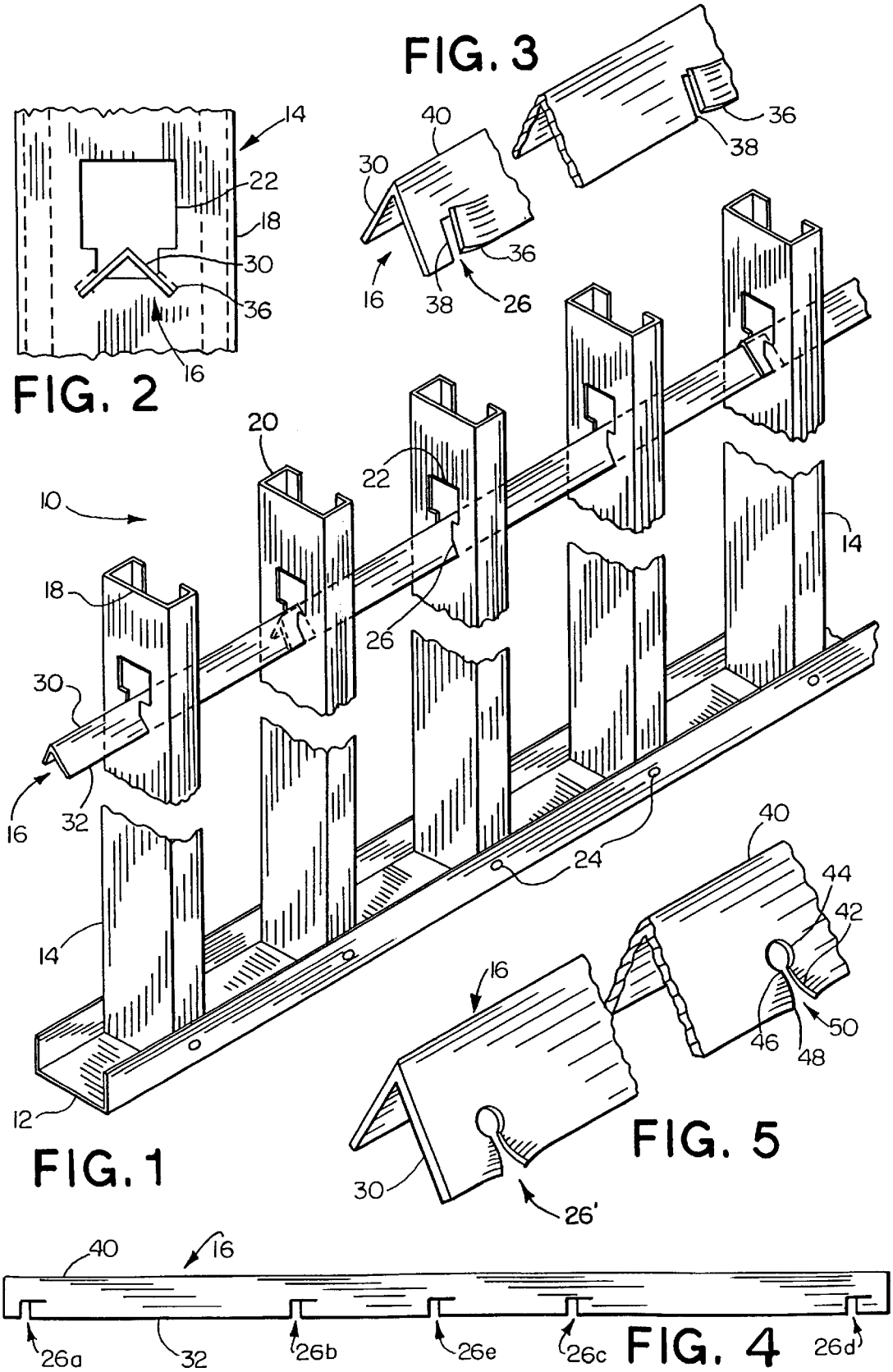
FIG. 1 is a perspective view of a metal stud wall including a stud spacer member according to the present invention.
FIG. 2 is an elevational view of a stud showing a stud spacer member according to the present invention disposed in an opening in a metal stud of the wall.
FIG. 3 is a perspective view of a stud spacer member according to the present invention, showing one form of notch used in the device.
FIG. 4 is a side view of a stud spacer member according to the present invention showing the preferred spacing of the notches.
FIG. 5 is a perspective view of a stud spacer member according to the present invention showing an alternative form of notch.

FIG. 1 illustrates the skeleton of a metal stud wall 10 according to the present invention. The metal stud wall 10 generally comprises a base member 12, a plurality of metal studs 14 disposed in a row, at least one spacer member 16, and wall panels (not shown). The wall panels, such as wall board, may be secured in well known manner to one or both sides of the metal studs to close the wall and form the exterior surface or surfaces of the wall.

The studs 14, as illustrated in FIG. 1, are generally C-shape. The studs 14 have a web 18 and a pair of L-shape flanges 20 perpendicular to the web 18. There is also one or more openings 22 in the web 18. The openings 22 heretofore have been provided in metal studs to permit electrical conduit and plumbing to be run within the stud wall. Since the openings 22 are located in the same position in the individual studs forming the wall as is conventional, the openings 22 are horizontally aligned with each other as shown in FIG. 1.

In the assembly of the metal stud wall 10, the metal studs 14 are secured at their lower ends to the base member 12 by fastening means 24, such as screws, rivets, etc. The base member 12 is a U-shape channel having a central planar strip with upstanding legs thereon. The studs forming the wall are secured by the fastening means 24 to the upstanding legs of the base member 12 that normally will be anchored to the floor.

The stud spacer member 16 is inserted through openings 22 located near the upper ends of the metal studs 14, and notches 26 in the stud spacer member are aligned with the web 18 of respective studs 14, or vice versa. The stud spacer member is moved downwardly, as by tapping, to move the webs 18 of the metal studs 14 into engagement with the notches 26. In this manner the stud spacer member 16 sets the spacing of the top ends of the studs 14, thus making it unnecessary to manually mark off the stud spacing at the top. As will be appreciated, only one stud need be plumbed and secured to surrounding structure, such as at its top to the ceiling track. With one stud plumbed and fixed in place, all of the other studs will be held plumb by the spacer member or chain of overlapping spacer members.

The stud spacer member 16 also functions to maintain the metal studs 14 at the prescribed spacing as during application of the wall panels to the studs thereby eliminating the need to secure the top end of each stud 14 to an upper channel or header. Although the wall panels once applied will maintain the spacing of the metal studs as well, the stud spacer member 16 may still function to assist in resisting relative movement of the metal studs in the plane of the wall and to resist bowing of the studs. In fact, additional spacer members may be provided at different heights to add strength to the metal stud wall skeleton.

As illustrated in FIG. 1, each stud spacer member 16 spans three metal studs 14 as is preferred, although longer spacer members may be used, if desired, to span four, five or more studs, or even shorter spacer members spanning only two studs. When forming a wall system having a number of metal studs exceeding the length of a single stud spacer member 16, a plurality of stud spacer members 16 are used in end-to-end relationship with relatively adjacent ends overlapped and secured to at least one common stud 14 so as to maintain continuity of the stud spacer members 16 over the length of the stud wall 10.

Referring now to FIGS. 2–4, a preferred embodiment of stud spacer member 16 can be seen to include a bar-like elongate member 30 which is generally V-shape in cross-section along its length. The V-shape functions to rigidify the elongate member 30 against lateral flexure, i.e., flexure perpendicular to the longitudinal axis of the spacer member. The V may have an included angle in the range of about 45° to 135°, more preferably in the range of about 60° to 120°, and most preferably about 90°.

The elongate member 30 need not necessarily be V-shape as shown in FIG. 3. The elongate member 30 alternatively could be generally planar with one or more bosses running (and overlapping if plural bosses are provided) the length of the elongate member 30. The boss or bosses (deflected out of the planar portions of the elongate member) would serve to rigidity the elongate member 30. Of course, other means may be provided to rigidify the elongate member 30 against lateral flexure, such as the use of stiffening ribs, a thicker stock, etc.

As illustrated in FIG. 3, the notches 26 preferably are provided in each planar side portion of the V-shape elongate member with the notches 26 opening to the longitudinal outer edge 32 of the respective side portion. The notches 26 are designed to engage and to retain the web 18 of the stud 14. As shown, the notches 26 have one side thereof formed by a resiliently flexible tab or flap 36 that functions to resiliently bias the web 18 against an abutment 38 formed by the opposite side of the notch. The flap 36 is formed by bending a portion of the respective side portion of elongate member 30 out of the plane of the side portion. The opposite edge of the notch preferably remains in the plane of the relatively adjacent region of the side portion to form a positive positioning stop or abutment 38 perpendicular to the longitudinal axis of the elongate member 30 against which the web 18 of the stud 14 will be held by the flexible flap 36. As is preferred, the corners of the flap 36 at its free end are preferably relatively sharply angled, as at an included angle of 60 degrees or less, to form a barb that will aid in holding the spacer member 16 engaged to the webs 18 of the metal studs 14.

Although the notches 26 are shown disposed along the outer edge 32 of each side portion, it should be realized that the notches 26 could be formed elsewhere, such as along the crease 40 of the V-shaped elongate member 30. However, preferably the notches 26 open to the outer edge of each side portion, with the notches 26 of one side portion being laterally aligned with corresponding notches of the other side portion. The pairs of laterally spaced notches 26, as opposed to a single notch, provide two points of contact for the stud spacer member 16. The two points of contact aid in preventing the studs 14 from pivoting or twisting, thus adding greater stability to the wall 10.

The distance between abutments 38 will equate to a distance between webs 18 of the studs 14 which form the skeleton of the wall 10, as the flap 36 will force the web 18 against the abutment 38. As will be appreciated, the distance between the cuts that form the abutments 38 and flaps 36 can be controlled within tight tolerances and this translates to accurate spacing of the studs in a row thereof forming a wall.

For example, in the United States, walls 10 are generally constructed with studs spaced on 16 or 24 inch centers. Therefore, a cut in the elongate member 30 will be made at 16 or 24 inch intervals, thus ensuring that the web to web spacing of the studs 14 will be 16 or 24 inches.

As illustrated in FIG. 4, the stud spacer member 16 preferably includes 4 notches 26*a*–26*d* spaced at 16 inch intervals, and 1 notch 26*e* equal spaced between the two central notches 26*b* and 26*c*. This particular arrangement of notches 26 creates a stud spacer member 16 which can be used in metal stud walls 10 which have a stud spacing of either 16 or 24 inches. If the wall 10 is to have a stud spacing of 16 inches, notches 26*a*–26*d* engage the webs 18 of the studs 14. If the wall 10 is to have a stud spacing of 24 inches, notches 26*a*, 26*d*, and 26*e* engage the webs 18 of the studs 14.

The overall length of the preferred stud spacer member 16 is about 50 inches, this leaving about one inch outside the outermost notches. The spacer member 16 is also sufficiently narrow to fit within the dimensions of the openings 22 in the webs 18. Also, it is particularly advantageous for the spacer member to be dimensioned so that it may be received in the reduced width conduit slot forming the lower portion of the stud opening as is often provided in the metal studs to centrally space conduit between the outer side edges of the metal studs. The reduced width conduit slot is typically one inch square. Accordingly, the width of the spacer member 16 in the preferred embodiment is approximately 1.25 inches when oriented as shown in FIG. 2 (i.e., from outer edge to outer edge), and the slots are formed in both legs of the V-shape elongate member to a depth from the edge of about ⅓ of an inch. Thus, in the preferred embodiment of the present invention, the member 16 has an overall length to width ratio of about 35 to 1. The metal which forms the stud spacer member 16 has a thickness ranging, for example, from about 22 gauge to 16 gauge. Preferably, the stud spacer member 16 is constructed from about 20 gauge metal, which has a thickness of about 0.036 inch.

Referring now to FIG. 5, another form of notch 26' can be seen to have a slot portion 42 and a relatively wider inner portion 44. The slot extends from the enlarged inner portion 44 to the outer longitudinal edge 32. The distinct transition from the slot portion 42 to the enlarged inner portion 44 forms angled shoulders 46 which "bite" into the metal of the web 18, thereby retaining the web 18 in the notch. The slot portion 42 of notch 26' should have a width which corresponds to and preferably is slightly less than the thickness of the metal forming the web 18, so that the slot portion 42 fits tightly over the web 18. The enlarged inner portion 44 and the outer longitudinal edge 32 of the side portion 42 define therebetween a resilient flap portion of the side portion that can flex away from the opposed flap portion to receive therebetween the web 18 of a metal stud 14. Preferably, the outer corners of the opposed flap portions are flared slightly out of the plane of the side portion to form slightly outturned ears 48 that define therebetween a widened mouth 50 for receiving and guiding the web 18 of the stud 14 into the narrower throat section of the slot portion 42.

Although the invention has been shown and described with respect to several preferred embodiments, it will be apparent that equivalent alterations and modifications will occur to others skilled in the art upon the reading and understanding of this specification. The present invention includes all such equivalent alterations and modifications, and is limited only by the scope of the following claims.

What is claimed is:

1. A metal stud wall comprising:

at least three metal studs each having at least two flanges interconnected by a web, the web of each stud having an opening and said studs being arranged in a row with the openings in the webs thereof horizontally aligned with one another; and at least one elongate member extending through said openings of said at least three studs, said elongate member having at least three longitudinally spaced apart notches engaging said webs of said studs;

wherein each of said notches has associated therewith a portion of the respective elongate member that bites into said web of said stud, thereby retaining said web in said notch.

2. A metal stud wall according to claim 1, wherein said notches are defined by an opening formed when a portion of said elongate member is bent out of a plane of said elongate member.

3. A metal stud wall according to claim 1, wherein said notches include an outer slot portion and a relatively wider inner portion, said outer slot portion extending from said wider inner portion to an edge of said elongate member.

4. A metal stud wall according to claim 1, wherein said at least one elongate member includes a second elongate member, said second elongate member extending through a said opening of one of said studs through which said one elongate member extends and through said openings in said webs of two further studs, said second elongate member having at least three equal spaced notches for respectively engaging said web of each of said studs through which it passes.

5. A metal stud wall according to claim 1, wherein said notches are equally spaced apart at a predetermined web to web spacing of said studs.

6. A metal stud wall according to claim 5, wherein said web to web spacing is 16 inches.

7. A metal stud wall according to claim 5, wherein said web to web spacing is 24 inches.

8. A stud spacer member comprising:

an elongate member having a longitudinally extending planar first portion and at least one second portion longitudinally coextensive with said first portion and deflected out of said plane of said first portion for rigidifying said elongate member against flexure about an axis perpendicular to the longitudinal axis of said elongate member; and at least three equal spaced notches disposed along said elongate member for receiving and engaging therein a web of a metal stud, wherein each of said first portion and said second portion includes at each said notch means for biting into the web of the stud.

9. A stud spacer member according to claim 8, wherein said elongate member includes a fourth notch equal spaced between at least two of said three notches.

10. A stud spacer member according to claim 8, wherein said notches are disposed along and open to a longitudinal edge of said first portion for receiving and engaging a web of a metal stud.

11. A stud spacer member according to claim 8, wherein said notches are defined by an opening formed when a portion of said elongate member is bent out of the plane of said elongate member.

12. A stud spacer member according to claim 8, wherein said notches include an outer slot portion and a relatively wider inner portion, said outer slot portion extending from said wider inner portion to an edge of said elongate member.

13. A stud spacer member according to claim 8, wherein said stud spacer member has a V-shape in cross-section along the length thereof with side portions thereof respectively forming said first portion and said second portion.

14. A stud spacer member according to claim 13, wherein said notches are disposed along and open to outer longitudinal edges of said side portions, each of said notches in one side portion being laterally aligned with a corresponding notch in the other side portion.

15. A stud spacer member comprising an elongate member having a plurality of longitudinally spaced apart notches for receiving and engaging therein a web of a metal stud, and at least one resilient device adjacent at least one side of each said notch for resiliently biasing the web of the stud towards and against an opposing side of each said notch, wherein each said elongate member includes at each said notch means for biting into the web of the stud.

16. A stud spacer member according to claim 15, wherein said elongate member has a longitudinally extending planar first portion and at least one second portion longitudinally coextensive with said first portion and deflected out of said plane of said first portion for rigidifying said elongate member against lateral flexure.

17. A stud spacer member according to claim 15, wherein said notches are formed in relatively planar portions of said elongate member and said at least one resilient device is formed by a resilient flap bent out of said planar portion.

18. A method for spacing a plurality of metal studs in a stud wall, comprising the steps of inserting a stud spacer member through aligned openings in at least three metal studs, and engaging longitudinally spaced apart notches in said stud spacer member with respective webs of said three metal studs, thereby establishing and maintaining a fixed spacing between the metal studs, wherein said engaging step includes causing a portion of the stud spacer member at each engaged notch to bite into the web of the stud to retain the web in the engaged notch.

19. A method as set forth in claim 18, further comprising the step of securing a bottom end of each of the studs to a base member.

* * * * *

UNITED STATES PATENT AND TRADEMARK OFFICE

CERTIFICATE OF CORRECTION

PATENT NO. : 6,021,618
DATED : February 8, 2000
INVENTOR(S) : William L. Elderson It is certified that error appears in the above-identified patent and that said Letters Patent is hereby corrected as shown below:

Title page,
Item [56], U.S. PATENT DOCUMENTS, insert the following:

| | | |
|---|---|---|
| -- 2,918,995 | 12/1959 | Kruger |
| 4,225,265 | 9/1980 | Hooker et al. |
| 5,784,850 | 7/1998 | Elderson -- |

Signed and Sealed this

Twenty-fourth Day of June, 2003

JAMES E. ROGAN
*Director of the United States Patent and Trademark Office*